US006318827B1

(12) United States Patent
Brenner et al.

(10) Patent No.: US 6,318,827 B1
(45) Date of Patent: Nov. 20, 2001

(54) METHOD OF IMPROVING PRINT QUALITY BY SELECTIVELY CHANGING PRINT DIRECTION

(75) Inventors: James M Brenner; Ronald E Sheely; Marc A Yousey, all of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/181,951

(22) Filed: Oct. 28, 1998

(51) Int. Cl.[7] ..... B41J 29/38; B41J 29/393; B41J 23/00; B41J 2/145; B41J 2/15

(52) U.S. Cl. ..... 347/9; 347/19; 347/37; 347/41

(58) Field of Search ..... 347/8, 9, 37, 41, 347/19; 400/323, 323.1

(56) References Cited

U.S. PATENT DOCUMENTS

| | | | | |
|---|---|---|---|---|
| 3,708,050 | | 1/1973 | McCarthy, Jr. | 400/323 |
| 5,250,956 | * | 10/1993 | Haselby et al. . | |
| 5,373,368 | * | 12/1994 | Taniguro | 358/296 |
| 5,745,145 | * | 4/1998 | Hirabayashi et al. | 347/183 |
| 5,988,784 | | 11/1999 | Takemura et al. | 347/8 |
| 6,074,042 | * | 6/2000 | Gasvoda et al. | 347/50 |

FOREIGN PATENT DOCUMENTS

| | | | |
|---|---|---|---|
| 0378759A2 | 7/1990 | (EP) | B41J/2/51 |
| 060143724 | 5/1994 | (JP) | B41J/19/18 |

* cited by examiner

*Primary Examiner*—John Barlow
*Assistant Examiner*—Alfred E Dudding
(74) *Attorney, Agent, or Firm*—Manuel Quiogue

(57) ABSTRACT

An ink jet printer wherein unidirectional or bidirectional printing is adaptively selected for predetermined print modes as a function of whether bidirectional alignment has been performed.

9 Claims, 5 Drawing Sheets

METHOD OF IMPROVING PRINT QUALITY BY SELECTIVELY CHANGING PRINT DIRECTION

BACKGROUND OF THE INVENTION

The disclosed invention relates to ink jet printing devices, and more particularly to techniques for achieving improved print quality on print media that is susceptible to print quality degradation due to ink drop placement misalignment.

An ink jet printer forms a printed image by printing a pattern of individual dots at particular locations of a pixel array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and commonly include a movable print carriage that supports one or more printheads each having ink ejecting nozzles. The print carriage traverses across the print medium along a carriage scan axis, and the nozzles are controlled to eject drops of ink at appropriate times pursuant to command of a microcomputer or other controller, wherein the timing of the application of the ink drops is intended to correspond to the pattern of pixels of the image being printed.

Insofar as there is relative motion along the carriage scan axis between the ink jet nozzles and the print medium as drops are being ejected, the actual placement of a drop on the print medium depends on the relative scan velocity and the ejection velocity of a drop (also called drop velocity or vertical velocity in those implementations wherein the nozzles are directed downwardly) which is generally orthogonal to the carriage scan axis. The carriage scan velocity can be accurately controlled, and the actual drop placement depends predominantly on drop velocity. A drop having a higher than nominal drop velocity will have a shorter flight time than a drop having a nominal drop velocity. Since an ejected drop has a carriage scan axis velocity imparted by the relative motion between the nozzles and the print medium, as referenced to the print media, a drop of higher than nominal drop velocity travels a shorter distance along the scan axis than a drop having nominal drop velocity, and strikes the print medium sooner, whereby the actual drop location will be displaced from the location at which a drop of nominal drop velocity would strike the print medium (a target or nominal drop location), in a direction opposite the relative scan direction as referenced to the print medium. A drop having a lower than nominal drop velocity will have a longer flight time than a drop of nominal drop velocity, and will strike the print medium later than a drop having a nominal drop velocity, whereby the actual drop location will be displaced from the location at which a drop of nominal drop velocity would strike the print medium, along the scan direction as referenced to the print medium.

As a result of manufacturing tolerances, drop velocity varies from printhead to printhead, while for any given example of a particular printhead drop velocity is reasonably constant for all of the nozzles thereof. In unidirectional printing wherein the direction of relative motion between the nozzles and the print medium while printing is always the same, variation in drop velocity from nominal does not affect print quality since the displacement of actual drop location from nominal will be substantially the same for each scan. However, in bidirectional printing wherein the nozzles are reciprocatingly scanned relative to the print media while printing, variation in drop velocity from nominal affects print quality, since the displacements from nominal of the actual drop placements depend on the scan direction. A straightforward manifestation of bidirectional misalignment is the non-colinearity of alternating segments of a vertical line, wherein the alternating segments are printed in opposing scan directions.

Bidirectional alignment is commonly achieved by shifting the print data along the carriage axis for one of the opposing scan directions, in increments of the carriage axis dot resolution, for example. The amount of print data shifts is determined for example by printing test patterns that include line segments that extend orthogonally to the carriage axis and are printed in opposite scan directions with different data shifts for a predetermined one of the opposing scan directions, and identifying the best pattern, either visually or opto-electronically.

While ink jet printers commonly include provisions for bidirectional alignment, a user might not perform such alignment when appropriate, for example after installation of a new ink jet cartridge. Accordingly, some printers use only unidirectional printing for certain high quality print modes or print modes that involve media that are susceptible to image quality degradation due to bidirectional misalignment.

There is therefore a need for adaptively utilizing bidirectional printing to increase throughput.

SUMMARY OF THE INVENTION

The disclosed invention is directed to an ink jet printer wherein bidirectional printing is enabled for print modes that involve media that are susceptible to image quality degradation due to bidirectional misalignment, if a bidirectional alignment has been performed. Media that are susceptible to image quality degradation due to bidirectional misalignment would include media on which deposited ink drops do not substantially spread out after impact. In other words, deposited ink drops remain small, whereby misalignments are readily noticeable.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
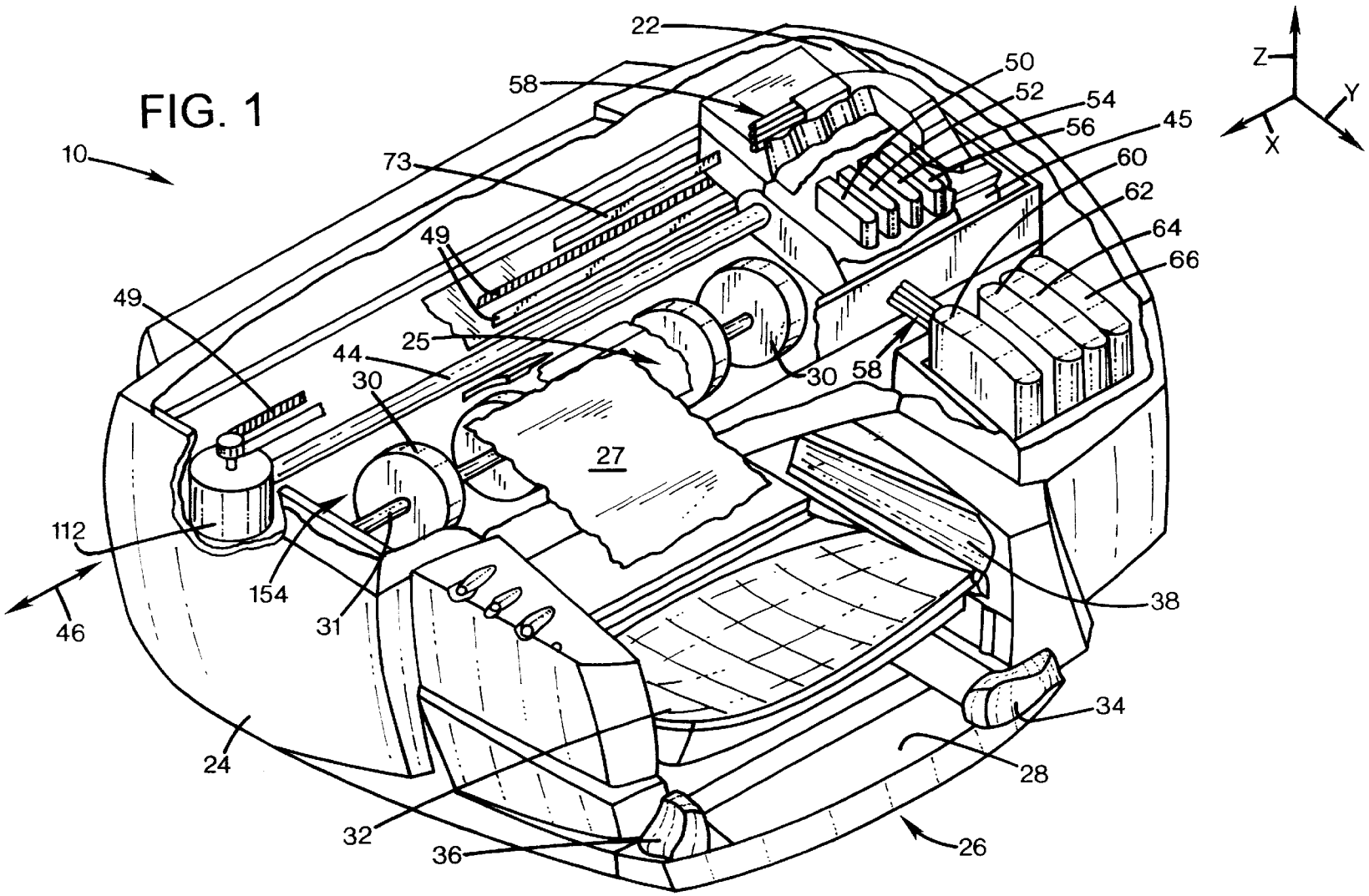
FIG. 1 is a perspective view of an ink jet printer incorporating the teachings of the present invention.

In the following detailed description and in the several figures of the drawing, like elements are identified with like reference numerals.

FIG. 1 sets forth a schematic perspective view of an example of an ink jet printing device 10 in which the disclosed invention can be employed. The ink jet printing device 10 includes a mechanism for causing reciprocating scanning between ink printheads and print media, and in accordance with the invention, high image quality is achieved by selectively enabling bidirectional printing for print modes intended to achieve best quality and/or print modes that involve print media that is susceptible to image quality due to bidirectional misalignment, if a bidirectional alignment has been performed. In other words, as to certain predetermined print modes, bidirectional printing is enabled only if bidirectional alignment has been performed.

For reference, a printer prints pursuant to receipt of a print job that is communicated to the printer as a single, continuous stream of data that is delimited or encapsulated by a Start Job command and an End Job command. For a given print job, a print mode is selected, commonly as a combination of media type and quality level such as Plain paper—Normal or Photo-Best. The selection of desired quality level and media type by selection of a print mode in turn determines several processing attributes such as rendering resolution, halftoning methods, carriage speed, print direction, swath height and others.

The ink jet printing device 10 of FIG. 1 more particularly includes a frame or chassis 22 surrounded by a housing, casing or enclosure 24, commonly made of a plastic material. Sheets of print media 27 are individually fed through a print zone 25 by a media handling system 26. The print media may be any type of suitable sheet material such as paper, card-stock, transparencies, coated paper, fabric, and the like.

The media handling system includes an input supply feed tray 28 for storing sheets of print media before printing. A print media drive roller assembly 154 formed of a plurality of laterally spaced drive wheels or tires 30 co-axially mounted on a common axle 31 and conventionally driven by a stepper motor and drive gear assembly (not shown) may be used to move the print media from the feed tray 28, through the print zone 25, and, after printing, onto a pair of extended output drying wing members 38, shown in a retracted or rest position in FIG. 1. The wing members 38 hold the newly printed sheet for a short time above any previously printed sheets still drying in an output tray 32, and then retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34 and a sliding width adjustment lever 36.

A carriage slider or guide rod 44 is supported by the chassis 22 to slidably support an off-axis ink jet print carriage system 45 for back and forth, or reciprocating, motion across the print zone 25 along a carriage axis 46 which is substantially parallel to the X-axis of an XYZ coordinate system shown in FIG. 1. A carriage scan axis drive motor 112 drives an endless belt 49 that is secured in a conventional manner to the print carriage 45, and a linear encoder strip 73 is utilized to detect position of the print carriage system 45 along the carriage scan axis, for example in accordance with conventional techniques.

In the print zone 25, a media sheet 27 receives ink from an ink jet cartridge, such as a black ink cartridge 50 and three single color ink cartridges 52, 54 and 56 which include respective printheads that selectively eject ink drops to form an image the media sheet in the print zone 25. By way of illustrative example, the print zone 25 is below the cartridges 50, 52, 54 and 56, and the printheads eject ink drops downwardly. Ink jet cartridges 50, 52, 54, and 56 are also commonly called "pens" by those in the art. In accordance with what is known as an "off-axis" ink delivery system, each of the pens 50, 52, 54 and 56 includes a small on-board reservoir for storing ink that is received from a replaceable main ink reservoir located separately from the pen. In the illustrated printer 10, ink of each color for each printhead is delivered via a conduit or tubing system 58 from a group of replaceable stationary ink reservoirs 60, 62, 64 and 66 to the on-board reservoirs of respective pens 50, 52, 54 and 56.

While the printhead cartridges 50, 52, 54, and 56 are disclosed as printhead cartridges that receive ink from respective remote ink reservoirs 60, 62, 64 and 66, it should be appreciated that the printhead cartridges can comprise self-contained printhead cartridges that have on-board ink reservoirs that are not coupled to remote ink reservoirs.

Each of the printheads of the pens 50, 52, 54 and 56 includes an orifice or nozzle plate having a plurality of ink ejecting nozzles formed therein in a manner well know to those skilled in the art. By way of illustrative example, the printheads of the pens 50, 52, 54 and 56 comprise thermal ink jet printheads. Other types of printheads may also be used, such as piezoelectric printheads.

Figure 2:
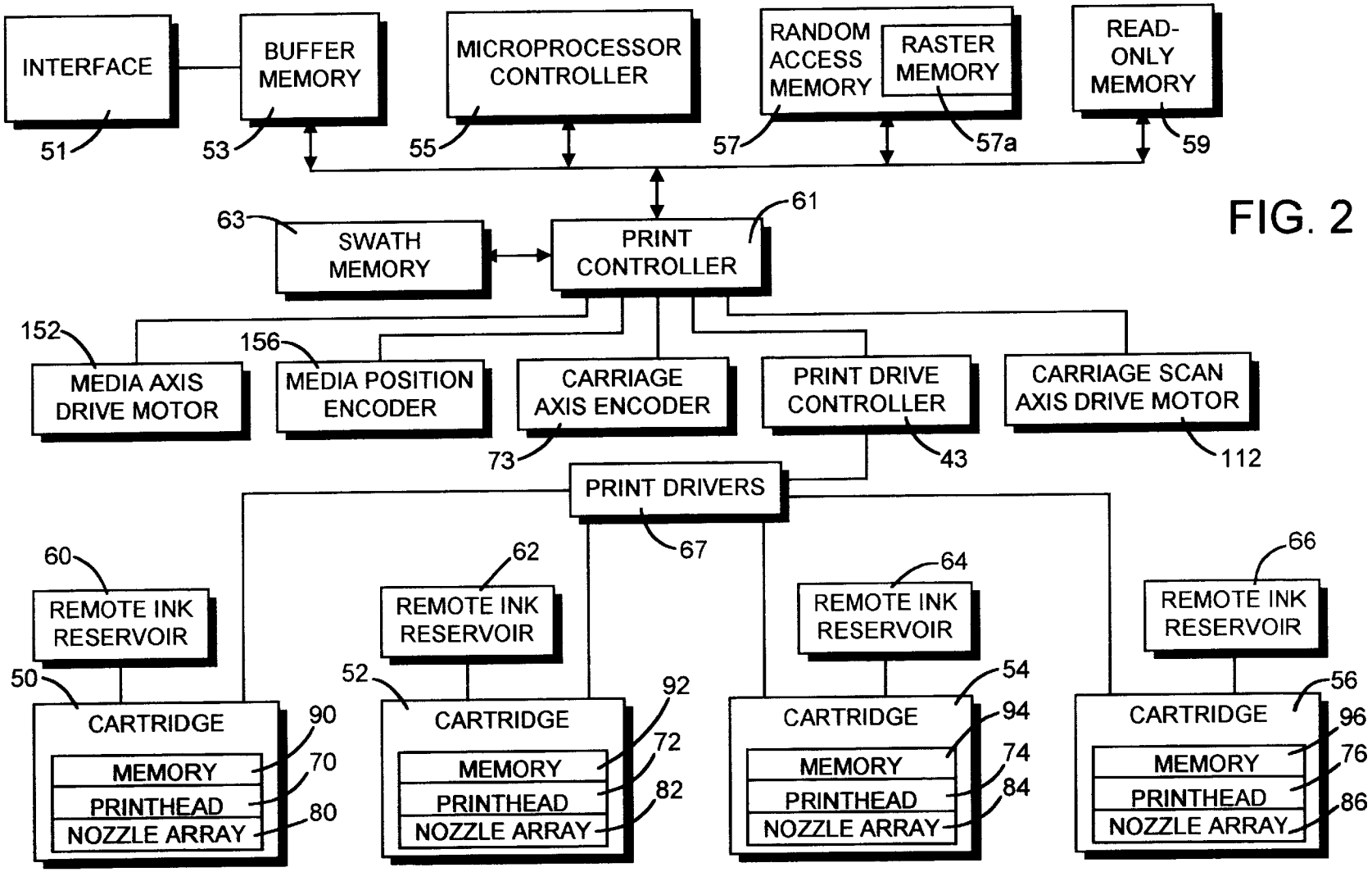
FIG. 2 is a simplified block diagram of a printer controller for controlling the swath printer of FIG. 1.

Referring now to FIG. 2, set forth therein is a simplified block diagram of a control system for controlling the ink jet printer of FIG. 1 in which the techniques of the invention can be implemented. The control system includes an interface 51 which receives print data from a host computer, for example, and stores the print data in a buffer memory 53. A microprocessor controller 55 is configured to process the print data to produce raster data that is stored in a bit-map raster memory 57*a* contained in a random access memory (RAM) 57 provided for the use of the microprocessor controller 55. A read-only memory 59 is also provided as appropriate for the use of the microprocessor controller 55.

A print controller 61 transfers portions of the raster data from the bit-map raster memory 57*a* to a swath memory 63 and provides swath data to a printhead driver controller 43 which controls printhead drivers 67 that drive the ink firing elements of printhead cartridges 50, 52, 54 and 56 that are implemented as single color printhead cartridges and/or as multi-compartment cartridges. The printhead cartridges 50, 52, 54 and 56 include respective printheads 70, 72, 74 and 76 which in turn include respective nozzle arrays 80, 82, 84 and 86 that emit a single color or multiple colors, wherein for example a nozzle array the emits multiple colors is arranged in subarrays that emit ink drops of respective colors.

The printhead cartridges 50, 52, 54 and 56 also include memory elements 90, 92, 94 and 96, for example resistor patterns, each of which contains information about the cartridge such as type, as well as a unique identifier. When a cartridge is installed, the control system reads the information stored in the associated memory element, for example to ensure that the cartridge is of the appropriate type for the particular printer. The control system can also determine whether the newly installed cartridge is a cartridge that had been removed subsequent to an earlier installation.

The print controller 61 further controls a media axis drive motor 152 which moves the print drive roller assembly 154 (FIG. 1) pursuant to media motion commands from the print controller 61. The media position encoder 156 provides information for the feedback control of the media axis drive motor 152. Similarly, the carriage axis encoder 73 provides feedback information for the feedback control of the carriage scan axis drive motor 112 which positions the print carriage 45 pursuant to carriage motion commands from the print controller 61.

Figure 3:
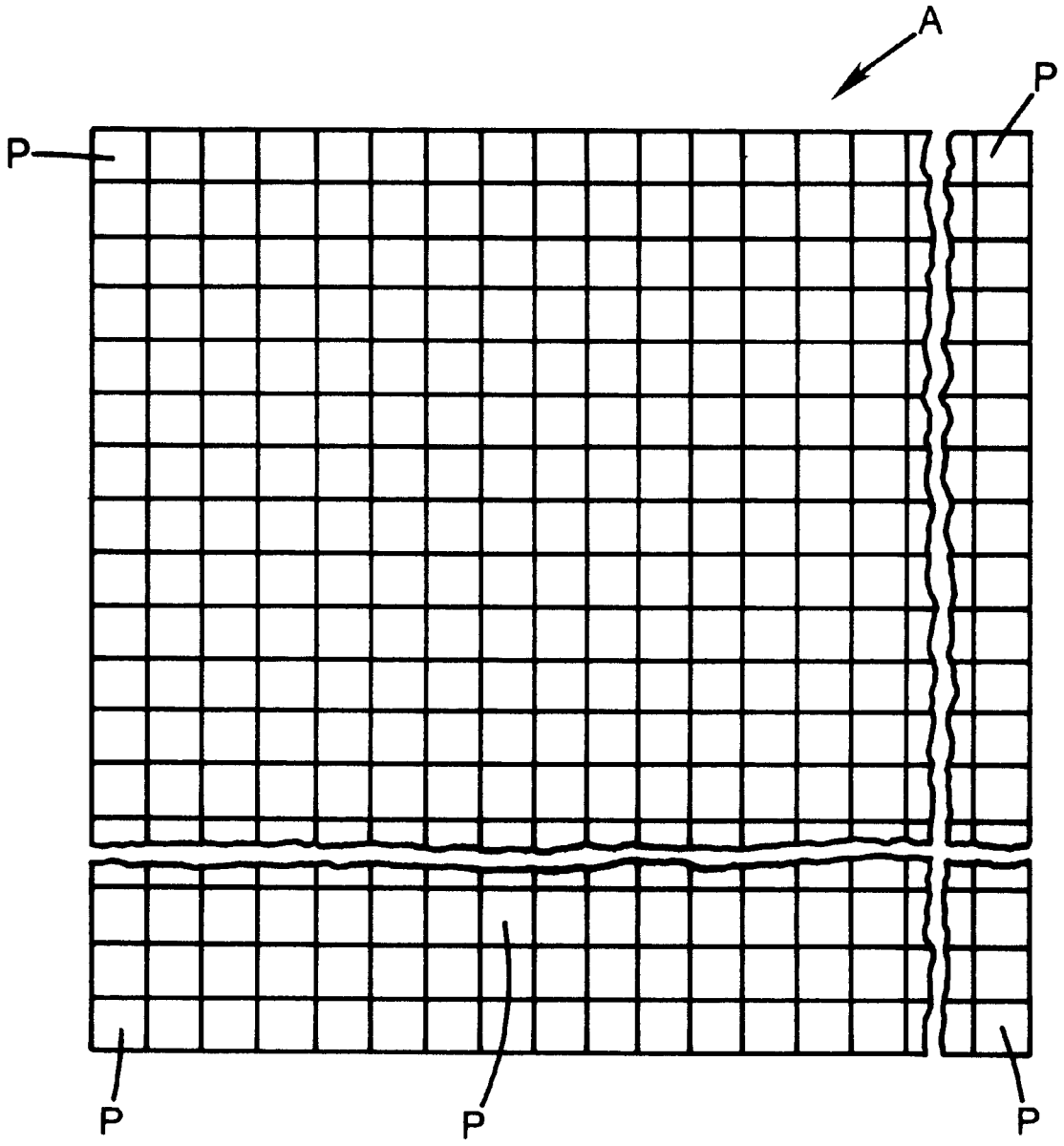
FIG. 3 schematically depicts a pixel array on which dots are selectively printed by the printer of FIG. 1.

Referring now to FIG. 3, the printer forms an image by scanning the print carriage along the carriage axis and printing dots at selected pixel locations P of a two-dimensional pixel array A defined for the print media. The pixel locations or pixels P are arranged in rows and columns, wherein the rows are aligned with the carriage scan axis and the columns are aligned with the media axis. The number of pixels per unit distance along the carriage scan axis is referred to as the carriage axis resolution, while the number of pixels per unit distance along the media axis is referred to as the media axis resolution. The center to center distance between adjacent columns is the carriage axis dot pitch, while the center to center distance between adjacent rows is the media axis dot pitch. Any given row is printed in at least one pass or scan of the print carriage, and the media is appropriately advanced after at least one pass of the print carriage.

In accordance with the invention, if a given print job is to be performed using a print mode intended to achieve best quality and/or a print mode that involves use of print media that is susceptible to print quality degradation due to ink drop placement misalignment, the print job is executed using bidirectional printing only if a bidirectional alignment procedure has been performed as to at least the printhead or printheads that will be used pursuant to the selected print mode. If a bidirectional alignment procedure has not been performed, the print job is executed using unidirectional printing.

In this manner, high print quality is achieved without forcing unidirectional printing, and with increased throughput if bidirectional alignment has been performed.

Figure 4:
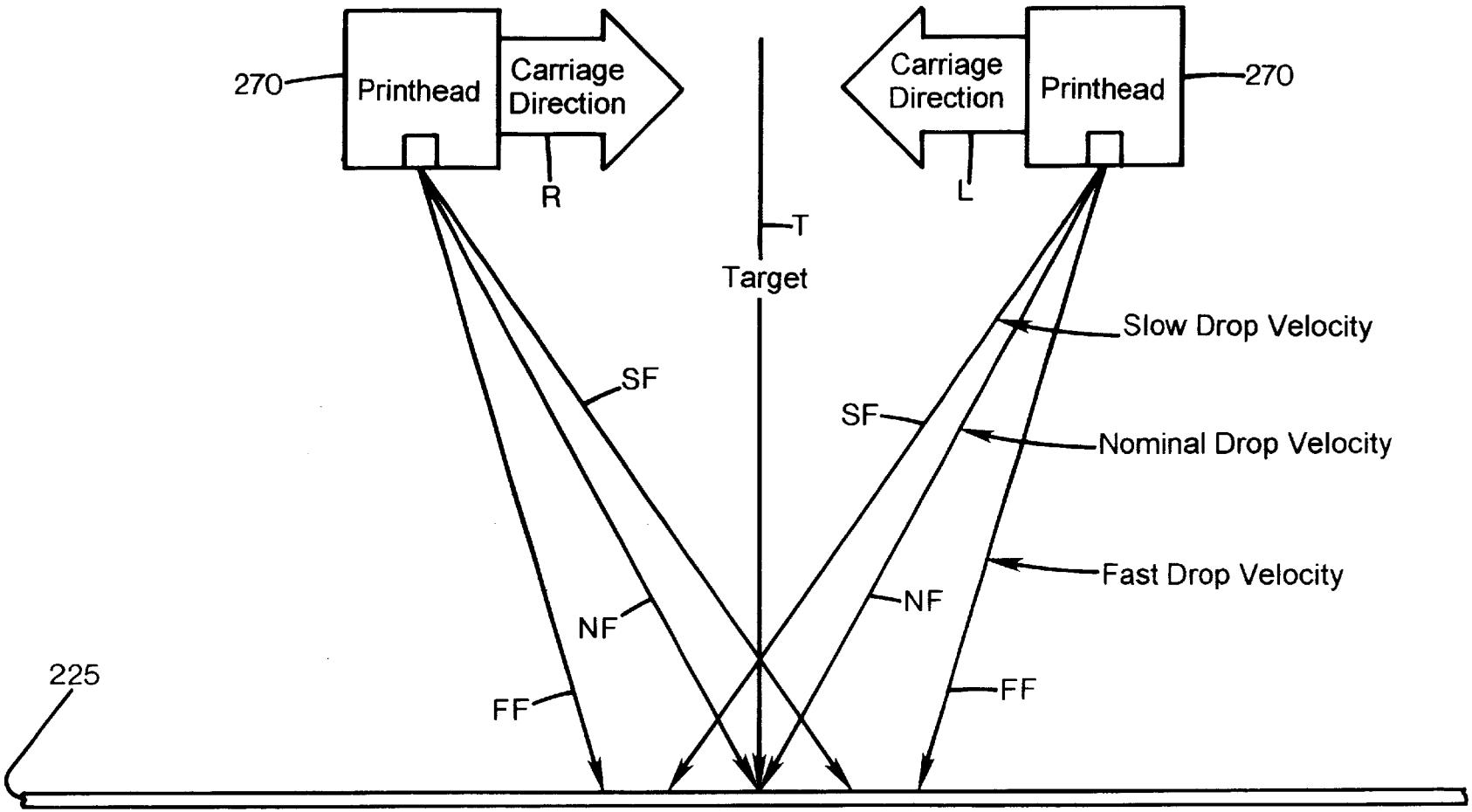
FIG. 4 schematically illustrates bidirectional dot misalignment due to printhead to printhead variation in drop velocity.

FIG. 4 schematically illustrates how printhead to printhead variation in drop velocity can lead to dot misalignment on print media 225 as to a specific target or nominal location T on the print media for opposing carriage scan directions L and R. In particular, as a printhead 270 is scanned in a particular carriage direction, a component of velocity along the carriage axis is imparted to an ejected drop, as referenced to the print media 225. Variation in drop velocity which is orthogonal to the carriage axis velocity results in variation in flight time which in turn results in variation in flight path, which ultimately results in variation in actual drop placement along the carriage axis. FIG. 4 schematically depicts the flight paths SF, NF and FF for slow, nominal and fast drops. A drop having a drop velocity that is slow relative to a nominal drop velocity has a greater than nominal flight time and travels a greater distance along the carriage axis than a drop having a nominal drop velocity. A drop having a drop velocity that is fast relative to a nominal drop velocity has a less than nominal flight time and travels a smaller distance along the carriage axis than a drop having a nominal drop velocity. Drop velocity in any particular example of a printhead is reasonably constant for all of the nozzles of such printhead, and bidirectional alignment compensates for printhead to printhead variations in drop velocity such that as to a given printhead drops intended for a given location along the carriage axis are actually placed at substantially the same location in each of the carriage scan directions.

Figure 5:
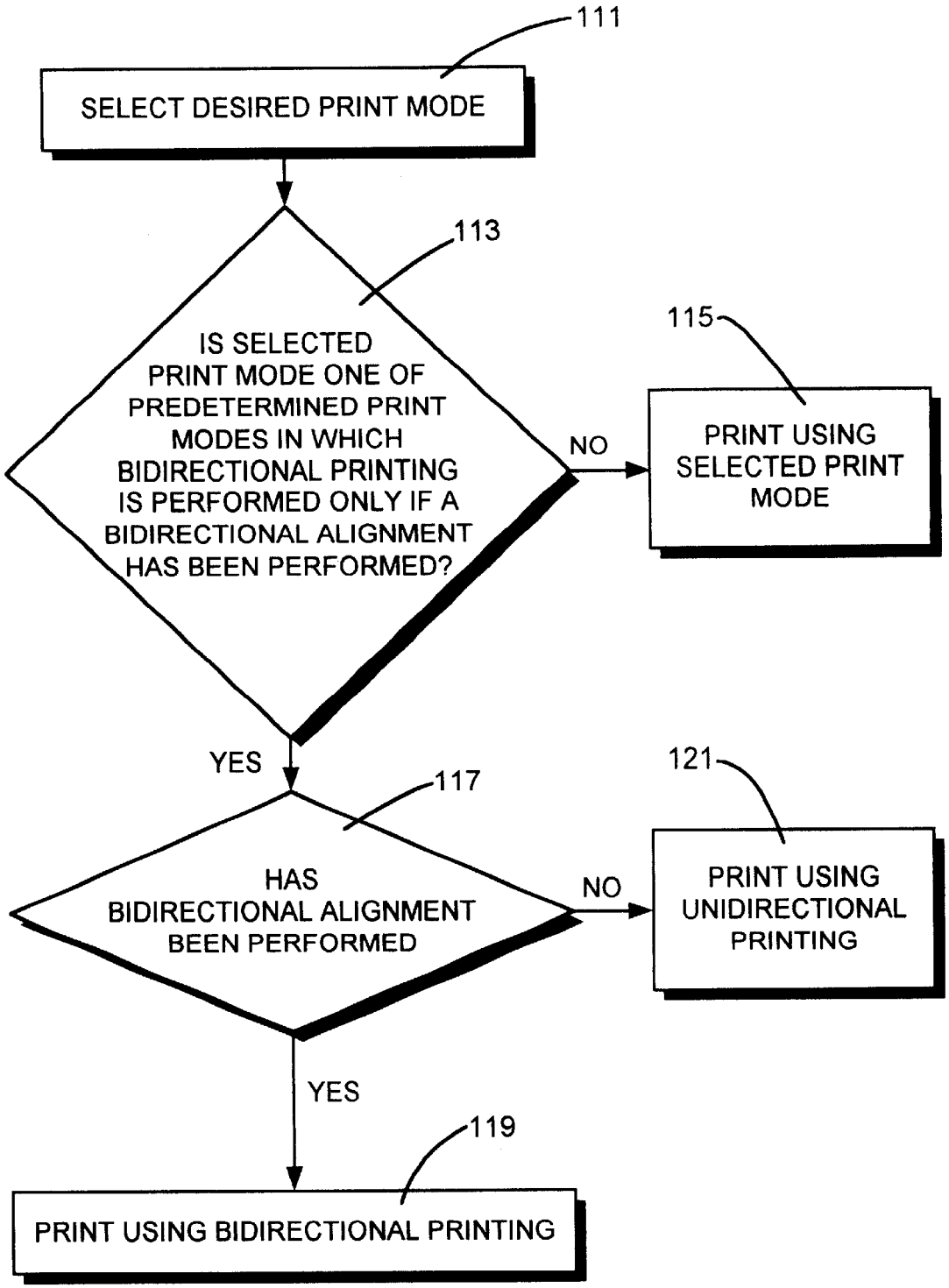
FIG. 5 sets forth a flow diagram of an illustrative procedure of operating an ink jet printer in accordance with the invention.

Referring now to FIG. 5, set forth therein is a flow diagram of an illustrative process of operating an ink jet printer in accordance with the invention. At 111 a user of the ink jet printer selects a desired print mode for a given print job, for example, Best, Normal, Draft, or Photo-Best, wherein Photo-Best is designed for printing on a glossy medium that is susceptible to print quality degradation due to ink drop placement misalignment. As is well known, media that is susceptible to print quality degradation due to ink drop placement misalignment includes media on which deposited ink drops do not substantially spread out after impact. Such media is sometimes called low gain media. At 113 a determination is made as to whether the selected print mode is one of predetermined print modes in which bidirectional printing is performed only if a bidirectional alignment has been performed as to the printhead or printheads presently in the printer. Such predetermined print modes could include print modes intended to achieve best quality and/or print modes that involve the use of media that is susceptible to print quality degradation due to ink drop placement misalignment. If the determination at 113 is no, then at 115 printing is performed using the selected print mode.

If the determination at 113 is yes, at 117 a determination is made as to whether a bidirectional alignment procedure has been performed as to the printhead or printheads in the printer. By way of illustrative example, the printer controller compares the identifiers of the cartridge or cartridges presently in the printer with stored identifiers of the cartridge or cartridges as to which the most recent bidirectional alignment has been performed.

If the determination at 117 is yes, at 119 bidirectional printing is performed. If the determination at 117 is no, at 121 unidirectional printing is performed. Depending upon implementation, it is sufficient to check as to whether bidirectional alignment has been performed as to each printhead that could be utilized for the selected print mode (i.e., the printhead or printheads that is/are available for use with the selected print mode). For example, if the selected print mode does not utilize the black printing printhead, then whether or not the black printing printhead had been bidirectionally aligned would not affect whether bidirectional printing would be performed. In other words, the determination as to whether bidirectional alignment has been performed is made as to at least the printhead or printheads that could be utilized in the selected print mode. It should be appreciated that as to any given print job, the printhead or printheads actually used for printing could be less than all of the printheads that could be used with the selected print mode.

Pursuant to the invention, unidirectional or bidirectional printing is adaptively selected for predetermined print modes as a function of whether bidirectional alignment has been performed, which advantageously achieves the desired high quality without constraining printing to unidirectional printing, and which achieves increased throughput if bidirectional alignment has been performed.

Although the foregoing has been a description and illustration of specific embodiments of the invention, various modifications and changes thereto can be made by persons skilled in the art without departing from the scope and spirit of the invention as defined by the following claims.

What is claimed is:

1. A method of operating an ink jet printer having a plurality of ink jet print elements that are reciprocatingly scanned along a scan axis relative to print media, comprising the steps of:

selecting a print mode;

determining whether a predetermined print mode has been selected;

if a predetermined print mode has been selected, determining whether a bidirectional print alignment has been performed;

bidirectionally printing with the ink jet printing elements if a predetermined print mode has been selected and if a bidirectional print alignment has been performed; and unidirectionally printing with the printing elements if the predetermined print mode has been selected and if a bidirectional print alignment has not been performed.

2. The method of claim 1 wherein the predetermined print mode involves use of print media that is susceptible to image quality degradation due to bidirectional misalignment.

3. A method of operating an ink jet printer having a plurality of ink jet printheads that are reciprocatingly scanned along a scan axis relative to print media, comprising the steps of:

selecting a print mode;

determining whether a predetermined print mode has been selected;

if a predetermined print mode has been selected, determining whether a bidirectional print alignment has been performed;

bidirectionally printing with the ink jet printheads if a predetermined print mode has been selected and if a bidirectional print alignment has been performed; and unidirectionally printing with the ink jet printheads if the predetermined print mode has been selected and if a bidirectional print alignment has not been performed.

4. The method of claim 3 wherein the step of determining whether a bidirectional print alignment has been performed comprises the step of determining whether a bidirectional print alignment has been performed as to at least each ink jet printhead that could be used pursuant to the selected print mode.

5. The method of claim 3 wherein the predetermined print mode involves use of print media that is susceptible to image quality degradation due to bidirectional misalignment.

6. An ink jet printer comprising:

a plurality of ink jet printing elements;

a support structure for supporting the plurality of ink jet printing elements for reciprocating movement along a scan axis relative to print media; and a processor for causing bidirectional printing with the ink jet printing elements if a predetermined print mode has been selected and if a bidirectional print alignment has been performed, and for causing unidirectional printing with the ink jet printing elements if the predetermined print mode has been selected and if a bidirectional print alignment has not been performed.

7. The ink jet printer of claim 6 wherein said plurality of ink jet elements are in at least one ink jet printhead.

8. The ink jet printer of claim 6 wherein said support structure includes a print carriage slidably supported on a slider rod.

9. The ink jet printer of claim 6 further including an off-axis ink delivery system for providing ink to the ink jet printing elements.

* * * * *